US009493971B2

(12) United States Patent
Promutico et al.

(10) Patent No.: US 9,493,971 B2
(45) Date of Patent: Nov. 15, 2016

(54) EMERGENCY DEVICE FOR A HOUSEHOLD APPLIANCE

(75) Inventors: Fabrizio Promutico, Turin (IT); Andrea Sacocci, Turin (IT)

(73) Assignee: Bitron S.P.A., Turin (IT)

( * ) Notice: Subject to any disclaimer, the term of this patent is extended or adjusted under 35 U.S.C. 154(b) by 373 days.

(21) Appl. No.: 14/123,845

(22) PCT Filed: Jun. 28, 2012

(86) PCT No.: PCT/IT2012/000202
§ 371 (c)(1),
(2), (4) Date: Feb. 19, 2014

(87) PCT Pub. No.: WO2013/001556
PCT Pub. Date: Jan. 3, 2013

(65) Prior Publication Data

US 2014/0159394 A1 Jun. 12, 2014

(30) Foreign Application Priority Data

Jun. 28, 2011 (IT) ..... RM2011A0342

(51) Int. Cl.
*E05B 15/02* (2006.01)
*E05C 19/02* (2006.01)
(Continued)

(52) U.S. Cl.
CPC ..... *E05C 19/02* (2013.01); *D06F 37/28* (2013.01); *D06F 39/14* (2013.01); *E05B 47/0009* (2013.01);
(Continued)

(58) Field of Classification Search
CPC ..... Y10S 292/65; Y10S 292/66; E05B 47/0009; E05B 47/0011; E05B 65/104; E05C 19/02; D06F 37/28; D06F 39/14
USPC ..... 292/152, 153, 209, 210, 341.16
See application file for complete search history.

(56) References Cited

U.S. PATENT DOCUMENTS 2,714,521 A * 8/1955 Graham ..... E05B 77/12 180/281
3,147,468 A * 9/1964 Daniels ..... E05B 45/083 134/166 R (Continued)

FOREIGN PATENT DOCUMENTS

| | | | | |
|---|---|---|---|---|
| EP | 1640493 | | 3/2006 | |
| GB | 335028 A | * | 9/1930 | ..... D06F 37/28 |
| GB | 1367578 | | 9/1974 | |

OTHER PUBLICATIONS

PCT International Search Report mailed on Oct. 2, 2012 for PCT Application PCT/IT2012/000202 filed on Jun. 28, 2012 in the name of BITRON S.P.A.

*Primary Examiner* — Carlos Lugo
(74) *Attorney, Agent, or Firm* — Steinfl & Bruno, LLP

(57) ABSTRACT

An emergency device for a household appliance of the type comprising a door that has a prong is described. The emergency device has an emergency member, movable between a rest position and an operating position, in which the emergency member engages with the prong of the door when the door is in a closed position, and control means, capable to hold the emergency member in the rest position. The control means has a security element, electrically connected to a control logic of the household appliance, such that when the safety element is crossed by a suitable current intensity and/or when a temperature surrounding the safety element exceeds a preset threshold, the security element melts releasing the emergency member, the emergency member passing irreversibly from the rest position to the operating position, engaging with the prong of the door when the door is closed.

9 Claims, 2 Drawing Sheets

(51) Int. Cl.

| | |
|---|---|
| ***D06F 37/28*** | (2006.01) |
| ***D06F 39/14*** | (2006.01) |
| *E05B 15/00* | (2006.01) |
| *E05B 47/00* | (2006.01) |
| *E05B 65/10* | (2006.01) |

(52) U.S. Cl.
CPC ..... *E05B 47/0011* (2013.01); *E05B 65/104* (2013.01); *Y10S 292/65* (2013.01); *Y10S 292/66* (2013.01); *Y10T 292/699* (2015.04)

(56) References Cited

U.S. PATENT DOCUMENTS 3,325,941 A * 6/1967 Prucha ..... E06B 5/164 187/314
3,705,739 A * 12/1972 Adler ..... E05B 65/104 16/48.5
4,012,066 A * 3/1977 Salvatore ..... E05B 65/104 292/341.13
4,032,180 A * 6/1977 Pohl ..... D06F 37/42 200/61.64
4,551,975 A * 11/1985 Yamamoto ..... B25J 9/1085 60/528
4,714,285 A * 12/1987 Langham ..... E05B 65/104 292/1
4,884,832 A * 12/1989 Bungard ..... E05B 65/104 292/150
5,046,426 A * 9/1991 Julien ..... F42B 15/36 102/377
5,121,950 A * 6/1992 Davidian ..... E05B 65/104 292/164
5,427,420 A * 6/1995 Moore ..... E05B 17/2088 292/169
5,520,424 A 5/1996 Hapke et al.
5,690,371 A * 11/1997 Turnbull ..... E05B 17/2092 292/163
5,782,509 A * 7/1998 Uyeda ..... E05B 65/104 292/341.17
6,008,992 A * 12/1999 Kawakami ..... E05B 47/0009 292/137
7,331,616 B2 * 2/2008 Brei ..... E05B 47/0009 292/100
7,364,209 B2 * 4/2008 Lomicka ..... E05B 15/0053 292/100
7,488,012 B2 * 2/2009 Eller ..... E05B 63/18 292/137
7,585,006 B2 * 9/2009 Alacqua ..... A47L 15/4259 292/244
7,617,703 B2 * 11/2009 Osvatic ..... D06F 37/28 68/12.26
8,979,143 B1 * 3/2015 Lin ..... E05B 17/2034 292/153
2004/0104580 A1 * 6/2004 Spiessl ..... D06F 37/42 292/84
2015/0013998 A1 * 1/2015 Kuehn ..... D06F 58/20 169/43

* cited by examiner

EMERGENCY DEVICE FOR A HOUSEHOLD APPLIANCE

CROSS REFERENCE TO RELATED APPLICATIONS

The present application is the US national stage of International Patent Application PCT/IT2012/000202 filed on Jun. 28, 2012 which, in turn, claims priority to Italian Patent Application RM2011A000342 filed on Jun. 28, 2011.

The present invention relates to an emergency device for a household appliance.

More specifically, the invention concerns an emergency device designed and realized in particular for washing machines and dryers, but that can be used for any type of household appliance, in which it is necessary to prevent the opening of a door in case of fire inside.

In the following, the description will be directed to a dryer, but it is clear that the same should not be considered limited to this specific use.

As it is well known, at present on a machine dryer (also known as "dryer"), and in particular on the door, there is only one device or mechanism to retain the door when closed. Said device is also known in the field as "Door-Latch".

The devices for retaining the door provide for the function of closing the door, but do not carry out any function in case of emergency. In fact, this kind of device comprises, in general, a closing hook with which the prong associated with the door is capable of engaging, a spring, adapted to hold the locking hook engaged with the prong and an electrical switch for the control of the state of the door.

In the driers, for example, it can happen that clothes subjected to drying can burn. This can happen for several factors, such as the synthetic material of which the clothes themselves can be made, the high temperatures of drying and the filling degree of the drying chamber. Although there are emergency devices, in particular typically electronic devices, which allow keeping closed the door. However, it is possible that the heat or flames may jeopardize the operation of the emergency electronic controls. Therefore, among operators it is felt the need to have an electronic control device, which, in case of extreme emergency, for example in the event that the internal temperature of the machine exceeds a presettable threshold and the electronics of the machine is not capable of operating correctly, can however stop the door.

In view of the above, it is therefore an object of the present invention to provide an emergency device for a household appliance, in particular a dryer, a washing machine or the like, capable of locking the door as a result of an increase of the surrounding temperature.

These and other results are achieved according to the invention with an electric circuit provided with a component capable to melt by a preset electric current passing through it or in case it is subjected to a predetermined temperature, so as to enable a door locking mechanism.

It is therefore a specific object of the present invention an emergency device for a household appliance of the type comprising a door that has a prong, said device comprising an emergency member, movable between a rest position and an operating position, in which said emergency member engages with said prong of said door, when said door is in closed position, and control means, capable to hold said emergency member in said rest position, characterized in that said control means comprise a security element, electrically connected to the control logic of said household appliance, such that when said safety element is crossed by a suitable current intensity and/or when the temperature surrounding said safety element exceeds a preset threshold, said security element melts releasing said emergency member, said emergency member passing irreversibly from said rest position to said operating position, engaging with said prong of said door, when said door is closed.

Always according to the invention, said safety element could be a fuse element, a jumper wire or the like.

Advantageously according to the invention, through said fuse element, jumper wire or the like, could pass a control signal, said control signal being an enabling signal, such that, if interrupted, the operation of said household appliance is inhibited, said control signal having a power that does not allow melting or breaking of said security element.

Still according to the invention, said device could comprise a container, having a base, on which a first opening is obtained, and a cover, on which a second opening is obtained, said first and second opening being facing each other and communicating by a channel, through which the prong of said door passes, said emergency member could comprise a hook, pivoted with said base and provided with a first tongue, said control means could comprise a first support or printed circuit, to which electrodes are connected to be connected with said control logic of said household appliance, a second support or printed circuit, having a hole, in which said first tongue of said emergency member is inserted, and said safety element could have a first terminal connected with said first support or printed circuit, and a second terminal fixed to said second support or printed circuit, said electrodes being electrically connected with said first and second terminal of said safety element.

Further according to the invention, said device could comprise returning means, suitable to exert a force on said emergency member to engage said emergency member with said prong when said emergency member passes from said rest position to said operating position.

Advantageously according to the invention, said returning means could include a spring fixed to said base and said emergency member.

Always according to the invention, said control means could comprise a further spring having the ends fixed between said first support or printed circuit and said second support or printed circuit, said further spring being arranged so as to make easier the passage of said emergency member from said rest position to said operating position, said further spring being an electrical conductor, in the circuit where said suitable current intensity flows to allow the melt of said safety element.

Still according to the invention, said device could comprise unlocking means of said emergency member, to allow the opening of said door when said emergency member is in said operating position, engaged with said prong of said door.

Further according to the invention, said emergency member could comprise a second tongue, and said unlocking means could comprise a rod, an eyelet and a spring interacting with a pin made on said base, said unlocking means being arranged so as to interact with said second tongue of said emergency member, so that, acting on said eyelet, said emergency member is disengaged from said prong, bringing said emergency member from said operating position to said rest position.

The present invention will be now described, for illustrative but not limitative purposes, according to its preferred embodiments, with particular reference to the figures of the enclosed drawings, wherein.

In the various figures, similar parts will be indicated by the same reference numbers.

Figure 1:
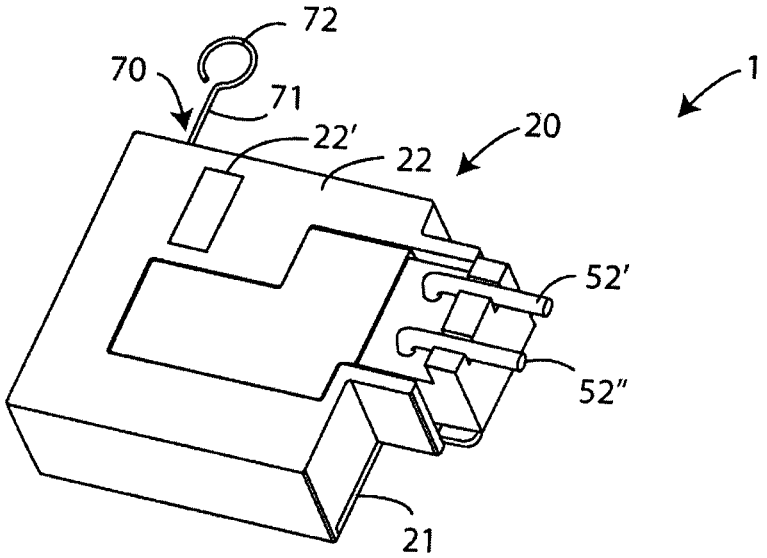
FIG. 1 shows a front perspective view of the emergency device according to the present invention.
Figure 2:
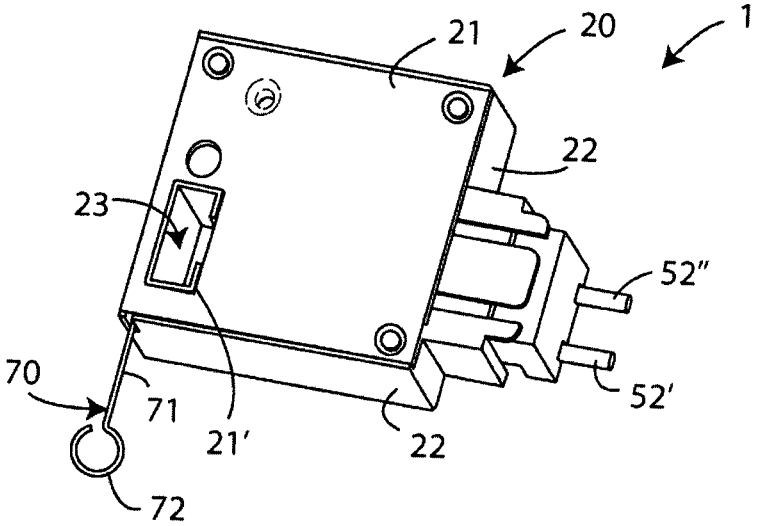
FIG. 2 shows a rear perspective view of the device according to FIG. 1.
Figure 3:
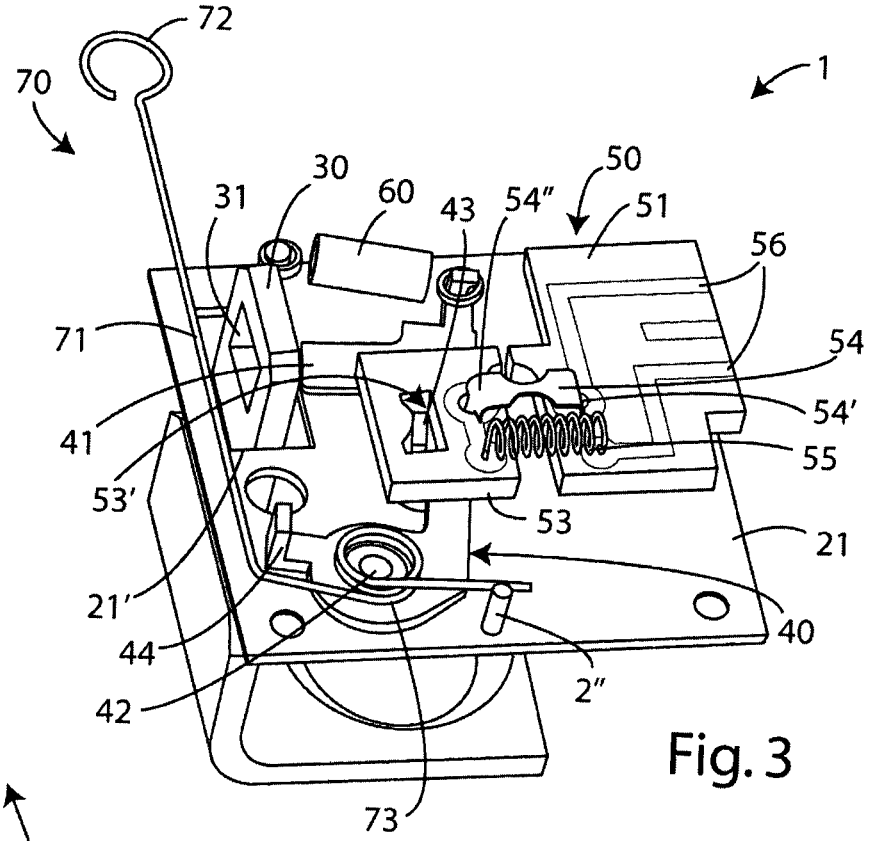
FIG. 3 shows the assembly of the components of the emergency device according to the invention in rest position.

Referring to FIGS. 1, 2 and 3, an emergency device 1 according to the invention for a household appliance (not shown in the figures) is shown, of the type comprising a locking hook and a door (also not shown in the figures), to which a prong 30 is associated, provided with a slot 31. The prong 30 is capable of engaging with said locking hook, when the door is closed.

The emergency device 1 is installed in correspondence of the locking hook, so that the prong 30 passes through said emergency device 1 before engaging with said locking hook, when the household appliance door is closed.

Said emergency device 1 comprises a container 20, having a base 21 and a cover 22. On said cover 22 and on said base 21 two openings are obtained, respectively 22' and 21', arranged facing one another and communicating through a channel 23, through which the prong 30 of said household appliance door passes.

In FIG. 3 it can be seen internally the emergency device 1 which comprises an emergency member 40, comprising a hook 41 and pivoted to said base 21, by means of the pivot 42, so that it can rotate with respect to it and it can assume a rest position, in which said hook 41 is disengaged from said slot 31 of the prong 30, and an operating position, in which said hook 41 is inserted into said slot 31, engaging with the prong 30.

Said emergency member 40 also comprises a first and a second tongue, indicated respectively by the reference numbers 43 and 44.

Said device 1 also comprises control means 50, comprising a first support or printed circuit 51, to which electrodes 52' and 52" are connected, which are, in their turn, connected with said control logic of said household appliance, and a second support or printed circuit 53, having a hole 53', suitably shaped, as it will be better explained below, in which said first tongue 43 of said emergency member 40 is inserted.

Said control means 50 comprise also a safety element 54, which in this embodiment is simply a fuse element and electrically conductive, such as a jumper wire or the like, which has a first terminal 54', fixed to said first support or printed circuit 51, and a second terminal 54", fixed to said second support or printed circuit 53. In addition, a spring 55 is bridge-connected between said first and second support or printed circuit 51 and 53, said spring 55 is made of metal, arranged in contraction, whose operation will be better defined in the following.

On said first and second support or printed circuit 51 and 53 electrical tracks 56 are obtained. Said electrodes 52' and 52", said electrical tracks 56, said spring 55 and said safety element 54 form an electrical circuit.

The emergency device 1 also comprises a spring 60, fixed between said base 21 and said emergency member 40, arranged in extension, whose operation will be better defined in the following.

Finally, the emergency device 1 comprises an unlocking member 70, of said emergency member 40, to allow opening of said door when said emergency member 40, is in said operating position, engaged with said prong 30 of said door. Said unlocking member 70 comprises a rod 71, an eyelet 72 and a spring 73 coupled with a pivot 21" formed on said base 21.

Said unlocking member 70 is movable between a first position and a second position. When said release member 70 is in said first position and said emergency member 40 is in said operating position, said second tongue 44 is located adjacent to said rod 71.

The operation of the emergency device 1 described above is as follows.

Consider the emergency device 1 in the configuration shown in FIG. 3, in which the door is closed, then the prong 30 is inserted into the channel 23, the emergency member 40 is in rest position, the hook 41 is disengaged from the slot 31, and then disengaged from the prong 30, the spring 60 is in extension and the safety element 54 is not damaged and counterbalances the action of said spring 60.

In addition, a control signal, logic or analog, of the dryer can pass through said safety element 54. Said control signal is an enable signal and has a power that does not allow melting or breaking of said safety element 54. Said control signal is such that if interrupted, the operation of the household appliance is inhibited.

In this configuration, prong 30 can be inserted and removed from channel 23, by engaging and disengaging to/from closing hook of the household appliance, without being subject to any interaction with the device 1.

In case of fire or combustion detected by the logic of the household appliance, said control, logic of the household appliance would transmit an electrical signal on said terminals 52' and 52", which would be added to said control signal, so as to cause the melting and then the breaking of said safety element 54, due to the passage of a current of suitable intensity in said electrical circuit comprised of said electrodes 52' and 52", said electrical tracks 56, said spring 55, which here operates only as an electrical conductor, and said safety element 54.

In case of the fire causes the failure of the control logic, the heat developed would increase the temperature near the emergency device 1, so as to cause, in any case, the melting and then the breaking of said safety element 54, beyond a presettable threshold.

Therefore, in case of fire, said safety element 54 will break, either as a result of a direct control of the control logic of the household appliance, or as a result of a temperature rise beyond a predefined threshold.

Figure 4:
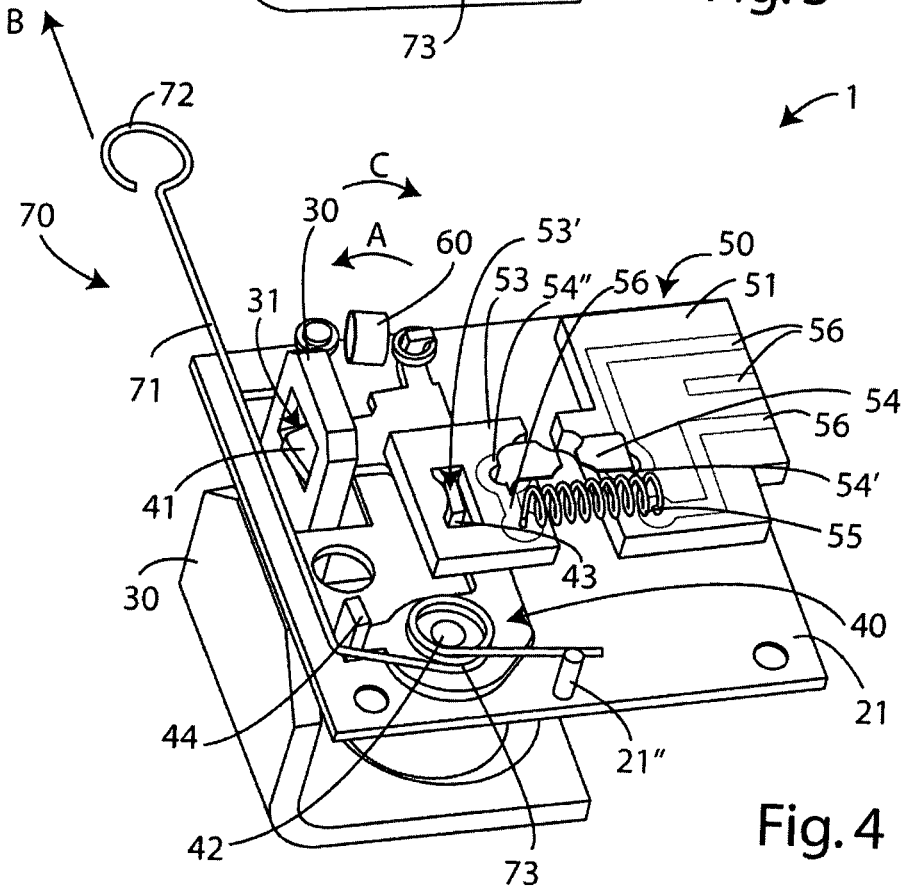
FIG. 4 shows the assembly of the components of the emergency device according to the invention in the locked position.

In any case, following the irreversible break (except in case of replacement of the same due to the intervention of a specialized technician) of said safety element 54, and now referring to FIG. 4, the spring 60, which is arranged in extension, tends to contract, the emergency member 40 rotates according to arrow A with respect to said pivot 42, said spring 55, which is arranged in contraction, tends to extend, pushing said second support or printed circuit 53. Said second support or printed circuit 53 is arranged in order to ease the rotation of said emergency member 40, due to the shape of said hole 53' and to the interaction of said tongue 43 with said hole 53', in which it is inserted. Accordingly, said emergency member 40 passes from said rest position to said operating position and said hook 41 is inserted in said slot 31 of the prong 30.

As said above, when said emergency member 40 is in said operating position and said unlocking member 70 in said first position, said second tongue 44 is substantially in contact with said rod 71 of said unlocking member 70. Considering that said second tongue 44 is at a certain radius away from said pivot 42, by pulling said eyelet 72 in the direction of arrow B, said unlocking member 70 passes from said first to said second position. Said rod 71 acts on said second tongue 44, causing the rotation of the emergency member 40 in the direction of arrow C, extracting hook 41 from said slot 31, releasing the prong 30 and allowing the opening of said door. Releasing the eyelet 72, the action of the spring 73 returns said unlocking member 70 in said first position and, therefore, said emergency member 40 in said operating position.

Furthermore, following the breaking of said safety element 54, even the interruption of said control signal there would occur. In this way, the operation of the dryer or household appliance in general is inhibited.

This ensures safety in case of emergency of said household appliance also in case, for example, of malfunctioning of the mechanical system described above.

The present invention has been described for illustrative but not limitative purposes, according to its preferred embodiments, but it is to be understood that modifications and/or changes can be introduced by those skilled in the art without departing from the relevant scope as defined in the enclosed claims.

The invention claimed is:

1. An emergency device for a latch mechanism of a household appliance, said latch mechanism comprising a prong on a door of said household appliance and a locking hook on the household appliance, said device comprising:

an emergency member, the emergency member being movable between a rest position and an operating position in which said emergency member engages with said prong of said door when said door is in a closed position, and control means, configured to hold said emergency member in said rest position, wherein:

said control means comprises a safety element, the safety element being electrically connected to a control logic of said household appliance, such that when said safety element is crossed by a suitable current intensity and/or when a temperature surrounding said safety element exceeds a preset threshold, said safety element melts thereby releasing said emergency member resulting in said emergency member passing from said rest position to said operating position, and engaging with said prong of said door when said door is in the closed position, and said safety element is a fuse element or a jumper wire, a control signal passing through said fuse element or jumper wire, said control signal being an enabling signal, allowing engaging and disengaging of the prong with the locking hook, such that, if interrupted, opening of said door of said household appliance is inhibited, said control signal having a power that does not melt or break said safety element.

2. The device according to claim 1, further comprising:

a container, the container having a base with a first opening, and a cover with a second opening, said first and second opening facing each other and communicating by a channel through which the prong of said door is adapted to pass, wherein said emergency member comprises a hook, the hook pivoted with said base and provided with a first tongue, wherein said control means comprise a first support or printed circuit, to which electrodes are connected, said first support or printed circuit configured to be connected with said control logic of said household appliance, and a second support or printed circuit, having a hole in which said first tongue of said emergency member is inserted, and wherein said safety element has a first terminal connected with said first support or printed circuit, and a second terminal fixed to said second support or printed circuit, said electrodes being electrically connected with said first and second terminal of said safety element.

3. The device according to claim 2, wherein said emergency member comprises a second tongue, and the device further comprises unlocking means of said emergency member, adapted for opening said door when said emergency member is in said operating position, engaged with said prong of said door, said unlocking means comprising a rod, an eyelet and a spring interacting with a pin made on a base, said unlocking means being arranged to interact with said second tongue of said emergency member, so that, acting on said eyelet, said emergency member is disengaged from said prong, bringing said emergency member from said operating position to said rest position.

4. The device according to claim 1, further comprising returning means, adapted to exert a force on said emergency member to engage said emergency member with said prong when said emergency member passes from said rest position to said operating position.

5. The device according to claim 4, wherein said returning means includes a spring fixed to said base and said emergency member.

6. The device according to claim 5 wherein said control means comprise a further spring having ends fixed between said first support or printed circuit and said second support or printed circuit, said further spring being arranged to facilitate passage of said emergency member from said rest position to said operating position, said further spring being an electrical conductor in a circuit where said suitable current intensity flows to melt said safety element.

7. An emergency device for a household appliance comprising a door with a prong, said device comprising:

an emergency member, the emergency member being movable between a rest position and an operating position in which said emergency member engages with said prong of said door when said door is in a closed position, and control means, configured to hold said emergency member in said rest position, wherein said control means comprises a safety element, the safety element being electrically connected to a control logic of said household appliance, such that when said safety element is crossed by a suitable current intensity and/or when a temperature surrounding said safety element exceeds a preset threshold, said safety element melts thereby releasing said emergency member resulting in said emergency member passing from said rest position to said operating position, and engaging with said prong of said door when said door is in the closed position, the emergency device further comprising:

a container, the container having a base with a first opening, and a cover with a second opening, said first and second opening facing each other and communicating by a channel through which the prong of said door is adapted to pass, wherein said emergency member comprises a hook, the hook pivoted with said base and provided with a first tongue, wherein said control means comprise a first support or printed circuit, to which electrodes are connected, said first support or printed circuit configured to be connected with said control logic of said household appliance, and a second support or printed circuit, having a hole in which said first tongue of said emergency member is inserted, and wherein said safety element has a first terminal connected with said first support or printed circuit, and a second terminal fixed to said second support or printed circuit, said electrodes being electrically connected with said first and second terminal of said safety element.

8. The device according to claim 7, wherein said emergency member comprises a second tongue, and the device further comprises unlocking means of said emergency member, adapted for opening said door when said emergency member is in said operating position, engaged with said prong of said door, said unlocking means comprising a rod, an eyelet and a spring interacting with a pin made on a base, said unlocking means being arranged to interact with said second tongue of said emergency member, so that, acting on said eyelet, said emergency member is disengaged from said prong, bringing said emergency member from said operating position to said rest position.

9. An emergency device for a household appliance comprising a door with a prong, said device comprising:

an emergency member, the emergency member being movable between a rest position and an operating position in which said emergency member engages with said prong of said door when said door is in a closed position, and control means, configured to hold said emergency member in said rest position, wherein said control means comprises a safety element, the safety element being electrically connected to a control logic of said household appliance, such that when said safety element is crossed by a suitable current intensity and/or when a temperature surrounding said safety element exceeds a preset threshold, said safety element melts thereby releasing said emergency member resulting in said emergency member passing from said rest position to said operating position, and engaging with said prong of said door when said door is in the closed position, the emergency device further comprising returning means, adapted to exert a force on said emergency member to engage said emergency member with said prong when said emergency member passes from said rest position to said operating position, said returning means including a spring fixed to said base and said emergency member, and wherein said control means comprise a further spring having ends fixed between said first support or printed circuit and said second support or printed circuit, said further spring being arranged to facilitate passage of said emergency member from said rest position to said operating position, said further spring being an electrical conductor in a circuit where said suitable current intensity flows to melt said safety element.

* * * * *